United States Patent [19]

Elliott et al.

[11] 4,144,181

[45] Mar. 13, 1979

[54] POLYMERIC ADDITIVES FOR FUELS AND LUBRICANTS

[75] Inventors: Robert L. Elliott, Scotch Plains; John B. Gardiner, Mountainside, both of N.J.

[73] Assignee: Exxon Research & Engineering Co., Florham Park, N.J.

[21] Appl. No.: 792,199

[22] Filed: Apr. 29, 1977

[51] Int. Cl.[2] ..... C10M 1/40; C10M 3/34; C10M 5/22; C10L 1/22

[52] U.S. Cl. ..... 252/33; 44/71; 44/72; 252/33.4; 252/47.5

[58] Field of Search ..... 252/33, 47.5, 33.4; 44/71, 72

[56] References Cited

U.S. PATENT DOCUMENTS

| | | | |
|---|---|---|---|
| 3,189,544 | 6/1965 | Ratner et al. | 252/33 |
| 3,272,743 | 9/1966 | Norman et al. | 252/33 |
| 3,624,115 | 11/1971 | Otto et al. | 252/33 |
| 3,634,241 | 1/1972 | Lowe | 252/33 |
| 3,649,661 | 3/1972 | Otto et al. | 260/429.7 |
| 3,808,131 | 4/1974 | Otto et al. | 252/32.5 |
| 3,846,316 | 11/1974 | Schiff et al. | 252/33 |
| 4,011,380 | 3/1977 | West et al. | 252/33.4 |
| 4,069,162 | 1/1978 | Gardiner et al. | 252/33.4 |
| 4,089,794 | 5/1978 | Engel et al. | 252/51.5 A |

*Primary Examiner*—Delbert E. Gantz
*Assistant Examiner*—Irving Vaughn
*Attorney, Agent, or Firm*—R. A. Dexter; F. T. Johmann

[57] ABSTRACT

Oil-soluble, derivatized ethylene copolymers derived from about 2 to 98 wt. % ethylene, and one or more $C_3$ to $C_{28}$ alpha-olefins, e.g. propylene, which are grafted, preferably solution-grafted under an inert atmosphere and at elevated temperatures and in the presence of a high-temperature decomposable free-radical initiator, with an ethylenically-unsaturated carboxylic acid material and thereafter reacted with a polyfunctional material reactive with carboxy groups; such as (a) a polyamine, or (b) a polyol, or (c) a hydroxy amine, or mixtures thereof to form carboxyl-grafted polymeric derivatives are reacted with oil-soluble hydrocarbyl substituted acids, preferably with long chain alkyl aryl sulfonic acids with an average side chain carbon number of about 20–40, to yield haze-free hydrocarbon solutions, e.g. a lubricant additives composition, of increased dispersant potency. Useful number average molecular weight ($\overline{M}_n$) of said copolymers range from about 700 to 500,000, however, if the molecular weight is from 10,000 to 500,000 then these copolymers are also useful as multifunctional viscosity index improvers.

16 Claims, No Drawings

POLYMERIC ADDITIVES FOR FUELS AND LUBRICANTS

BACKGROUND OF THE INVENTION

1. FIELD OF THE INVENTION

This invention relates to haze-free polymeric dispersant additives for lubricating oils which may also be useful as viscosity-index improvers for lubricating oils. More particularly, this invention relates to haze-free solutions of substantially saturated polymers comprising ethylene and one or more $C_3$ to $C_{28}$ alpha-olefins, preferably propylene, which have been grafted in the presence of a free-radical initiator with an ethylenically-unsaturated carboxylic acid material preferably at an elevated temperature and in an inert atmosphere, and thereafter reacted first with a polyfunctional material reactive with carboxy groups, such as (a) a polyamine, (b) a polyol or (c) a hydroxy amine, or mixtures thereof, to form multifunctional polymeric reaction products and thereafter with at least a haze preventing amount of an oil-soluble acid.

2. DESCRIPTION OF THE PRIOR ART

It is well known that the introduction of carboxylic acid groups onto ethylene copolymers provides a means for derivatizing said copolymers. One means of introducing the carboxylic groups is by grafting of maleic anhydride onto said polymer as by a free radical mechanism.

Belgian Pat. No. 843,360 teaches the production of soluble, sludge-dispersing additives for hydrocarbon fuels and lubricating oils by the free-radical induced grafting in solution of an ethylenically-unsaturated dicarboxylic acid material such as maleic anhydride onto a substantially saturated copolymer comprising ethylene and at least one other alpha-olefin at an elevated temperature to provide, without substantial polymer degradation, a useful precursor copolymer which can be subsequently reacted with a carboxylic acid reacting polyfunctional material, such as a polyamine, a polyol or a hydroxyamine or mixtures of these, to form multifunctional polymeric derivatives having particular utility as engine sludge and varnish control additives for lubricating oils.

It is often found that during the preparation, processing and storage of these various oil-soluble grafted hydrocarbon polymers a haze develops in their oil concentrates. The source of this haze does not appear to be the same as that haze resulting from incompatibility of the several additives in a lubricating oil additive concentrate (see U.S. Pat. No. 3,897,353 wherein haze resulting from component incompatibility is overcome in a lubricating oil additive concentrate by blending an amorphous ethylene-propylene copolymer with an N-alkyl methacrylate containing polymer) but rather, the haze appears the result of oil-insoluble, infilterable and therefore undesirable by-products of the graft reaction. German DOS No. 2,634,033 teaches that the grafting of olefinic copolymers with an ethylenically unsaturated, polar nitrogen containing monomer, e.g. 2-vinyl pyridine, yields a homopolymer as a highly undesirable by-product of most graft reactions.

It is an object of this invention to provide a haze-free, grafted ethylene copolymeric dispersant, generally useful as a mineral oil viscosity index improver of increased sludge performance and/or enhanced thickening activity.

SUMMARY OF THE INVENTION

It has been discovered that a wide variety of haze products including the homopolymer and highly polar grafted copolymer form upon carrying out the graft reaction of Belgian Pat. No. 843,360. Surprisingly, the reaction of the derivatized products/byproducts of the graft reaction with oil-soluble acids, such as a long chain alkyl aryl sulfonic acid, has been found to prevent or significantly reduce the amount of haze separating from oil solutions of said grafted ethylene copolymers.

A similar approach to overcoming haze in mineral solutions of non-grafted ethylene copolymeric V.I. improvers is taught in U.S. Ser. No. 628,342, now U.S. Pat. No. 4,069,162 (of common assignee with this application) wherein the haze containing oil compositions are reacted with an anti-hazing amount of an oil-soluble strong acid containing a hydrogen dissociating moiety which has a pK of less than about 2.5, e.g. a $C_{25}$ to $C_{70}$ hydrocarbyl substituted sulfonic acid. The hazing substance overcome thereby was an oil-insoluble metal salt of a carboxylic acid generally introduced during the processing of the copolymer. Now, it has been found that reacting the derivatized-grafted polymeric additive and byproducts of Belgian Pat. No. 843,360 by the process of said U.S. Ser. No. 628,342 cleared the haze. Moreover, it was found that this reaction when said oil-soluble sulfonic acid was used produced a novel oil-soluble composition in the form of a sulfonic amine salt and/or sulfonamide which novel composition has surprisingly improved sludge handling performance over the untreated material of the prior art.

The subject matter of this invention is exemplified in a composition comprising a lubricating oil having dissolved therein at least a sludge dispersing amount, generally ranging from about 0.1 to about 50 wt. %, based on the total weight of said composition, of an oil-soluble grafted, derivatized ethylene polymeric viscosity index improver containing nitrogen, and from about 0.01 to 8, preferably 2 to 4, wt. % of an oil-soluble hydrocarbyl substituted acid preferably having a pK of less than about 2.5, optimally a long chain alkyl aryl sulfonic acid with an average side chain carbon number of about 18 to 40.

The process of the invention can be considered a process for improving the multifunctional activity of an oil additive concentrate comprising a hydrocarbon solvent, from 0.1 to 50 wt. % based on the total weight of said concentrate of a derivatized-grafted ethylene $C_3$–$C_{28}$ $\alpha$-olefin copolymeric viscosity index improver having a molecular weight ($\overline{M}_n$) of 700 to 500,000 and a $\overline{M}_w/\overline{M}_n$ ratio of less than 7 comprising the step of reacting said concentrate with an oil-soluble hydrocarbyl substituted acid having from about 10 to 70 carbons by adding said acid in an amount of from about 0.01 to 8 wt. % based on the weight of said concentrate and maintaining said concentrate at a temperature ranging from about 20° to about 250° C. and for a period of 0.1 to 20 hours.

In a preferred method according to the invention, haze is eliminated and/or prevented in an oil additive composition comprising a hydrocarbon solvent, from 0.1 to 50 wt. %, based on said solvent of a grafted derivatized copolymer viscosity index improver having a molecular weight ($\overline{M}_n$) of 700 to 500,000 and a hazing substance produced by said graft and having a particle diameter ranging from about 0.01 microns to about 15 microns by the step of treating said composition with a polymethylene substituted benzene sulfonic acid, said polymethylene substituent having a molecular weight of about 350, in an amount of from about 0.01 wt. % to 8 wt. % at a temperature within the range of about 150° C. to about 200° C. and for a period from about 0.1 hour to about 20 hours, e.g. for 1 hour at 190° C. This method results in an additive oil composition which has no visually perceptible haze. The anti-hazing agent of the novel oil compositions of the invention appears to convert at least part, i.e. the visually perceptible part, of the oil-insoluble hazing substances to an oil-soluble material.

It is believed that this conversion of the oil-insoluble haze causing agent to the oil-soluble material involves conversion of said haze causing agent to an oil-soluble amine salt and/or amide of said strong acid. It is a feature of this instant invention that said strong acid, e.g. the sulfonic acid, also reacts with said grafted nitrogenated polymeric dispersant to form a novel sulfonic product, e.g. a sulfonic ammonium salt. Thus, a consequence of the preferred embodiment of this instant invention is that the sludge dispersant activity of a multifunctional viscosity index improver is markedly enhanced by introduction of ammonium salt and/or amide bond onto the ethylene copolymeric graft pendant nitrogen sites reactive with said strong acid, i.e. the ability of the reacted dispersant sites to suspend sludge is greatly enhanced over the unreacted dispersant sites.

Thus, this invention also relates to the novel graft ethylene copolymeric derivatized compositions of the sulfononium-amine salts and sulfonamides types as well as hydrocarbon fuels and lubricants containing the oil-soluble acid reacted graft copolymers prepared as described herein.

DETAILED DESCRIPTION OF THE PRESENT INVENTION

In a broad sense, the teachings of the present invention can be extended beyond graft reactions and considered to be effective with all substantially linear polymeric hydrocarbon polymers containing a polar-nitrogen group. This includes nitrogen-containing polymeric hydrocarbon copolymers formed by: (1) direct copolymerization of the monomers; (2) chemical modification of the polymer backbone; (3) grafting onto oxidized degraded substrates; and (4) aminated acyl, acyloxy and amidoyl derivatives thereof.

In a more restricted sense, the teachings of the present invention are applicable to all graft reactions wherein haze is produced as an undesired byproduct and has particularly utility for solution grafting reactions.

CARBOXYLIC GRAFTING OF ETHYLENE COPOLYMERS

The Ethylene Copolymer

The ethylene copolymers to be grafted in accordance with this haze-clearing invention contain from about 2 to about 98, preferably 30 to 80 wt. % of ethylene, and about 2 to 98, preferably 20 to 70, wt. % of one or more $C_3$ to $C_{28}$, preferably $C_3$ to $C_{18}$, more preferably $C_3$ to $C_8$, alpha-olefins, e.g. propylene. Such copolymers preferably have a degree of crystallinity of less than 25 wt. %, as determined by X-ray and differential scanning calorimetry, and a number average molecular weight ($\overline{M}_n$) in the range of about 700 to about 500,000, preferably 10,000 to 250,000, as determined by vapor phase osmometry (VPO) or membrane osmometry. Copolymer of ethylene and propylene are most preferred. Other alpha-olefins suitable in place of propylene to form the copolymer or to be used in combination with ethylene and propylene to form a terpolymer include 1-butene, 1-pentene, 1-hexene, 1-octene; also branched chain alpha-olefins, such as 5-methylpentene-1 and 6-methylheptene-1 and mixtures thereof.

Terpolymers of ethylene, said alpha-olefin and a non-conjugated diolefin or mixtures of such diolefins may also be used. The amount of the non-conjugated diolefin ranges from about 0.5 to 20 mole percent, preferably about 1 to about 7 mole percent, based on the total amount of ethylene and alpha-olefin present. Representative diolefins include cyclopentadiene, 2-methylene-5-norbornene, nonconjugated hexadiene, or any other alicyclic or aliphatic nonconjugated diolefin having from 6 to 15 carbon atoms per molecule, such as 2-methyl or ethyl norbornadiene, 2,4-dimethyl-2-octadiene, 3-(2-methyl-1-propene) cyclopentene, ethylidene norbornene, etc.

These ethylene copolymers, this term including terpolymers, may be prepared using the well-known Ziegler-Natta catalyst compositions as described in U.K. Pat. No. 1,397,994.

Such polymerization may be effected to produce the ethylene copolymers by passing 0.1 to 15, for example, 5 parts of ethylene; 0.05 to 10, for example, 2.5 parts of said higher alpha-olefin, typically propylene; and from 10 to 10,000 parts of hydrogen per million parts of ethylene; into 100 parts of an inert liquid solvent containing (a) from about 0.0017 to 0.017, for example, 0.0086 parts of a transition metal principal catalyst, for example, $VOCl_3$; and (b) from about 0.0084 to 0.084, for example, 0.042 parts of cocatalyst, e.g. $(C_2H_5)_3Al_2Cl_3$; at a temperature of about 25° C. and a pressure of 60 psig for a period of time sufficient to effect optimum conversion, for example, 15 minutes to one-half hour; all parts being parts by weight.

Ethylenically Unsaturated Carboxylic Acid Materials

These materials which are grafted (attached) onto the copolymer and then subjected to the haze-clearing, dispersant activity increasing process of the present invention are organic compounds which contain at least one ethylenic bond and at least one, preferably two, carboxylic acid or its anhydride groups or a polar group which is convertible into said carboxyl groups by oxidation or hydrolysis. Maleic anhydride or a derivative thereof is preferred as it does not appear to homopolymerize appreciably but grafts onto the ethylene copolymer or terpolymer to give two carboxylic acid functionalities. Such preferred materials have the generic formula

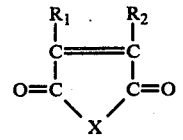

wherein $R_1$ and $R_2$ are hydrogen or a halogen and X is oxygen, NH or $NR_3$ wherein $R_3$ is a hydrocarbyl amine or alkyl group, e.g. a $C_1$ to $C_{40}$ alkyl, preferably $C_1$ to $C_{18}$ alkyl. Suitable examples include chloromaleic anhydride, itaconic anhydride, N-hexyl maleimide or the corresponding dicarboxylic acids, such as maleic acid or fumaric acid.

Another preferred class are the monocarboxylic types as the acrylics and methacrylics which have the generic formula:

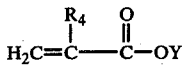

wherein $R_4$ are hydrogen or an alkyl group, e.g. a $C_1$ to $C_4$ alkyl, preferably methyl and Y is hydrogen or methyl. Suitable examples include acrylic and methacrylic acid, methyl acrylate and methyl methacrylate.

Grafting of the Polymer

The free-radical induced grafting of ethylenically unsaturated carboxylic acid materials in solvents, such as benzene is known in the art (see U.S. Pat. No. 3,236,917). The grafting according to the process of this invention is carried out at an elevated temperature in the range of about 100° C. to 250° C., preferably 120° to 190° C., and more preferably 150° to 180° C., e.g. above 160° C., in a solvent, preferably a mineral lubricating oil solution containing, e.g. 1 to 50, preferably 5 to 30 wt. %, based on the initial total oil solution, of the ethylene polymer and preferably under an inert environment. The grafting is carried out in the presence of a high-temperature decomposable compound capable of supplying free radicals at said elevated temperature.

The free-radical initiators which may be used are peroxides, hydroperoxides, and azo compounds and preferably those which have a boiling point greater than about 100° C. and decompose thermally within the grafting temperature range to provide said free radicals. Representative of these free-radical initiators are azobutyronitrile and 2,5-dimethyl-hex-3-yne-2,5 bis-tertiary-butyl peroxide, sold as Lupersol 130 by Wallace and Tiernan, Inc., or its hexene analogue. The initiator is used at a level of between about 0.005% and about 1%, based on the total weight of the polymer solution.

The ethylenically unsaturated carboxylic acid material, e.g. maleic anhydride, is used in an amount ranging from about 0.01% to about 10%, preferably 0.1 to 0.8%, based on the weight of the initial total oil solution. The aforesaid carboxylic acid material and free radical initiator are used in a weight percent ratio range of 1.0:1 to 30:1, preferably 2.0:1 to 5:1, more preferably 2.0:1 to 2.6:1.

The grafting is preferably carried out in an inert atmosphere, such as by nitrogen blanketing. While the grafting can be carried out in the presence of air, the yield of the desired graft polymer is decreased as compared to grafting under an inert atmosphere. The inert environment should be substantially free of oxygen. The grafting time ranges from about 0.1 to 12 hours, preferably from about 0.5 to 6 hours, more preferably 0.5 to 3 hours. The graft reaction is carried out to at least approximately 4 times, preferably at least about 6 times the half-life of the free-radical initiator at the reaction temperature employed, e.g. with 2,5-dimethyl hex-3-yne-2,5-bis(t-butyl peroxide) 2 hours at 160° C. and one hour at 170° C.

In the grafting process, the copolymer solution is first heated to grafting temperature and thereafter said carboxylic acid material and initiator are added with agitation although they could have been added prior to heating. When the reaction is complete, the excess acid material is eliminated by an inert gas purge, e.g. nitrogen sparging.

In the grafting step, the maleic anhydride or other carboxylic acid material used is grafted onto both the polymer and the solvent for the reaction. The wt. % grafted onto the polymer is normally greater than the amount grafted onto the oil due to greater reactivity of the polymer to grafting. However, the exact split between the two materials depends upon the polymer and its reactivity, the reactivity and type of oil, and also the concentration of the polymer in the oil. The split can be measured empirically from the infra red analyses of product dialyzed into oil and polymer fractions and measuring the anhydride peak absorbance in each.

The grafting is preferably carried out in a mineral lubricating oil which need not be removed after the grafting step but can be used as the solvent in the subsequent reaction of the graft polymer with the polyfunctional material and as a solvent for the end product to form the concentrate.

Polyamines

Useful polyamines for reaction with the grafted ethylene-containing polymers include polyamines of about 2 to 60, e.g. 3 to 20, total carbon atoms and about 2 to 12, e.g. 2 to 6 nitrogen atoms in the molecule, which amines may be hydrocarbyl polyamines or may be hydrocarbyl polyamines including other groups, e.g., hydroxy groups, alkoxy groups, amide groups, imidazoline groups, and the like. Preferred amines are aliphatic saturated polyamines, including those of the general formula:

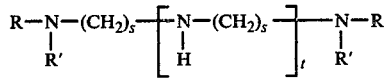

wherein R and R′ are independently selected from the group consisting of hydrogen, $C_1$ to $C_{25}$ straight or branched chain alkyl radicals, $C_1$ to $C_{12}$ alkoxy $C_2$ to $C_6$ alkylene radicals, $C_2$ to $C_{12}$ hydroxy or amino alkylene radicals, and $C_1$ to $C_{12}$ alkylamino $C_2$ to $C_6$ alkylene radicals, s is a number of from 2 to 6, preferably 2 to 4, and t is a number of from 0 to 10, preferably 2 to 6.

Examples of suitable amine compounds include ethylene diamine, 1,2-diaminomethane, 1,3-diaminopropane, 1,4-diaminobutane, 1,6-diaminohexane, diethylene triamine, triethylene tetraamine, tetraethylene pentamine, 1,2-propylene diamine, di-(1,2-propylene) triamine, di-(1,3-propylene) triamine, N,N-dimethyl-1,3-diaminopropane, N,N-di(2-aminoethyl)ethylene diamine, N,N-di-(2-hydroxyethyl)-1,3-propylene diamine, and N-dodecyl-1,3-propane diamine.

Other useful amine compounds include alicyclic diamines such as 1,4-di-(aminomethyl) cyclohexane and heterocyclic nitrogen compounds such as imidazolines N-amino alkylmorpholines and N-amino-alkyl piperazines of the general formula:

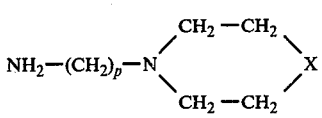

wherein X is O or N-G, G is hydrogen or an omega-aminoalkylene radical of from 1 to 3 carbon atoms and p is an integer of from 1 to 4. Examples of such amines include 2-pentadecyl imidazoline, N-(2-aminoethyl)

piperazine, N-(3-aminopropyl) piperazine, and N,N'-di-(2-aminoethyl) piperazine, N-(3-aminopropyl) morpholine and methyl amino pyridine.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene groups, forming such compounds as diethylene triamine, triethylenetetramine, tetraethylene pentamine and isomeric piperazines. Low cost poly(ethylene amines) compounds having a composition approximating tetraethylene pentamine are available commercially under the trade name Polyamine 400. Still other polyamines separated by hetero atom chains such as polyethers or sulfides can be used.

Polyols

Useful polyols for reaction with the grafted ethylene-containing polymers are polyhydric, preferably hydrocarbyl, alcohols containing from about 2 to about 30, preferably 2 to 6, carbon atoms and from about 2 to about 10, preferably 2 to 5, hydroxyl radicals; for example, glycerol, alkylene glycols such as dipropylene glycol, trimethylol ethane, trimethylol propane, and pentaerythritol which is preferred.

Hydroxy Amines

Useful hydroxy amines for reaction with the grafted ethylene-containing polymer are primary and secondary amines having 2 to 30 carbon atoms, preferably 2 to 6 carbon atoms, 1 to 6 hydroxy groups, preferably 2 to 3 hydroxy groups, and 1 to 10 nitrogen atoms, such as tris-hydroxymethyl aminomethane, diethanolamine and diisopropanolamine, etc. The products obtained from a 2,2-disubstituted-2-amino-1-alkanol having 2 to 3 hydroxy groups and containing a total of 4 to 8 carbon atoms as represented by 2-amino-2-(hydroxymethyl)-1,3-propanediol (also known as tris-hydroxy methylaminomethane) are preferred. Other examples of said hydroxy amines include 2-amino-2-methyl-1,3-propanediol; 2-amino-2-ethyl-1,3-propanediol, etc.

Multifunctionalization(Derivatize) Process

The grafted polymer, preferably in solution, can be readily reacted with said polyamines, polyols, hydroxy amines and mixtures thereof by admixture together and heating at a temperature of from about 100° C. to 250° C. for from 10 minutes to 30 hours, preferably 10 minutes to 10 hours, usually about 15 minutes to about 3 hours. It is preferred to use 0.01 to 2.5 mole, more preferably 0.5 to 1.0 mole, of the polyfunctional material, e.g. polyamine, polyol or hydroxyamine, per mole of grafted carboxylic material such as maleic anhydride. The reaction of diethylene triamine with the grafted ethylene-containing polymer occurs in 15 minutes or less at 170° C. with a nitrogen blanket.

The solution grafting step when carried out in the presence of a high temperature decomposable peroxide is accomplished without degradation of the chain length (molecular weight) of the ethylene-containing polymer. Measurement of molecular weights and degradation can be evaluated by determination of the thickening efficiency of the polymer.

Thickening efficiency (T.E.) is defined as the ratio of the weight percent of a polyisobutylene (sold as an oil solution by Exxon Chemical Co. as Paratone N), having a Staudinger Molecular Weight of 20,000, required to thicken a solvent-extracted neutral mineral lubricating oil, having a viscosity of 150 SUS at 37.8° C., a viscosity index of 105 and an ASTM pour point of 0° F., (Solvent 150 Neutral) to a viscosity of 12.4 centistokes at 98.9° C., to the weight percent of a test copolymer required to thicken the same oil to the same viscosity at the same temperature. T.E. is related to ($\overline{M}_n$) and is a convenient, useful measurement for formulation of lubricating oils of various grades.

The oil having attached, grafted carboxyl, e.g. maleic anhydride, groups when reacted with the polyfunctional derivatives, e.g. polyamine, is also converted to the corresponding derivatives. If desired, the split between the derivatized graft polymer and the derivatized graft oil can be determined by dialysis into polymer and oil fractions and infrared or nitrogen analysis of the fractions.

The final reaction product contains in the range of 0.001 to 25, preferably 0.01 to 10, wt. % nitrogen and/or oxygen and has a $\overline{M}_n$ in the range of 700 to 500,000, preferably 700 to 250,000. For the polymeric additives of higher molecular weight, i.e. a $\overline{M}_n$ of from about 10,000 to about 500,000, e.g. 10,000 to 250,000, (useful for pour depressant and/or V.I.-improving applications), the nitrogen and/or oxygen content ranges from about 0.001 to 5 wt. percent, preferably 0.01 to 0.5 wt. %. For polymeric additives of lower molecular weights, i.e. $\overline{M}_n$ of less than about 10,000 (useful as pour depressant and/or dispersant), the nitrogen and/or oxygen content ranges broadly from about 0.001 to 25 wt. %, preferably from 0.01 to 8 wt. %.

GRAFT POLYMERIZATIONS

The application of the present instant invention is not limited to haze-clearing of solution grafted materials alone, but in a broader sense is applicable to all graft reaction processes wherein haze is produced. For example, the graft copolymers taught in German DOS No. 2,634,033 based on U.S. Ser. 600,652 which teaches direct grafting of vinyl monomers such as 2-vinyl pyridine to an ethylene/propylene copolymer or an ethylene/propylene/diene terpolymer or other polyolefinic backbones can be treated by the process of this instant invention to yield a haze-free lube oil concentrate of enhanced dispersancy. Thus olefinic graft copolymers formed by initiation with free radical catalysts such as 85% t-butyl perbenzoate in either aromatic or hydrocarbon, e.g. mineral oil, solvents with vinyl monomers such as 2-vinyl pyridine, 4-vinyl pyridine, dimethylaminoethyl methacrylate, n-vinyl pyrollidone, etc., can be treated with alkyl, aromatic or alkaryl sulfonic acids such as Sulfonic Acid SA-119, sold by Esso S.A. France of Port Jerome, France. SA-119 (a 90% active oil concentrate of $C_{18}$–$C_{35}$($C_{24}$ ave.) alkyl benzene sulfonic acid having a ($\overline{M}_n$) of 500) treated graft polymer solutions produce a clear, haze-free additive product of increased dispersancy.

Oil-Soluble Hydrocarbyl Substituted Strong Acid

In accordance with the practice of this invention, the hazy oil additive composition will be treated with an oil-soluble acid, said acid preferably containing a hydrogen dissociating moiety which has a pK of less than about 2.5, generally from about 0.001 to about 2.5. The term pK for the purpose of this disclosure is used herein to express the extent of the dissociation of the acid used to treat the haze causing substance which is derived from a metal-containing dispersion. Thus, pK can be defined as the negative logarithm to the base 10 of the equilibrium constant for the dissociation of the oil-soluble strong acid. For the purposes of this invention, preferred acids have a pK of up to about 2.5 and optimally ranges from about 0.1 to about 2.

Useful acids which eliminate the hazing property of the hazing substance are represented by oil-soluble derivatives of alkyl carboxylic acids such as isostearic acid, maleic acid, malonic acid, phosphoric acid, thiophosphoric acids, pgosphonic acid, thiophosphonic acids, phosphinic acid, thiophosphinic acids, sulfonic acid, sulfuric acid, sulfinic acid and alphasubstituted halo- or nitro- or nitrilo-carboxylic acids wherein the oil solubilizing group of groups are hydrocarbyl and containing from about 3 to about 70, preferably from about 18 to 40, optimally 25 to 32 carbon atoms.

Particularly preferred for use in this invention for treating the hazing substance are the oil-soluble sulfonic acids which are typically alkaryl sulfonic acids. These alkylaryl sulfonic acids generally have from 9 to 76, preferably 24 to 46, total carbons. The alkyl substituent or substituents preferably have 18 to 40, optimally 24 to 32, total carbons.

These sulfonic acids suitable for this application can be prepared by several techniques. They may be entirely synthetic or prepared by sulfonation of natural petroleum derived alkyl aromatics. An example of the latter would be the sulfonic acids from the sulfuric acid, sulfur trioxide and the like treatment of petroleum fractions. Acids of this type which are particularly useful possess molecular weights within the range of 300 to 650, preferably about 450 to 550.

Suitable alkylaromatics for subsequent sulfonation can be synthesized by several techniques. For example, benzene, toluene, naphthalene or phenol can be alkylated with an olefinic fraction or a chlorinated paraffin using a Friedel-Crafts catalyst. The olefins in turn may be produced by oligomerization of ethylene, propylene, higher alpha-olefins or isobutylene using appropriate catalyst systems. Waxy paraffinic fractions can be chlorinated to a suitable level, e.g. one or more Cl atoms per molecule and subsequently reacted with an aromatic using $AlCl_3$ as the catalyst. Other methods can also be used.

Sulfonation may be conducted using any one of several reagents under appropriate conditions. Oleum, concentrated $H_2SO_4$, $SO_3$, $SO_3$ complexes and $ClSO_3H$ are examples. Probably 20% oleum and $SO_3$ are the most popular reagents and $SO_3$ the best for this application.

With oleum, the reagent, in a 5–15 wt. % excess would be added slowly to the alkyl aromatics in a nonreactive hydrocarbon solvent with vigorous mixing and temperature control (about 25–35° C.) The majority of the unreacted sulfuric acid and sludge would then be separated using gravity settling after dilution with water. A water or water alcohol wash is then used to remove the last traces of sulfuric acid.

The alkyl aromatic can be sulfonated with $SO_3$ swept into the system with a dry carrier gas. Again a nonreactive solvent would be employed to reduce viscosity and facilitate mixing. Alternately, the alkylaromatic can be sulfonated with liquid $SO_3$ dissolved in liquid $SO_2$.

Thus, in summary a preferred class of sulfonic acids for use as additives according to this invention consists of monosulfonated alkylated mono- and/or bicyclic aromatic sulfonic acids which are formed by alkylating an aromatic nucleus and thereafter sulfonating the alkylated product. The alkyl group or groups of the alkylated mono- and bicyclic aromatic compounds average from 4 to 64, preferably from about 20 to about 40, total carbons and the group or groups may be straight chain and/or branched in structure. The preferred sulfonic acids for use in the invention are ones that are derived from sulfonation of mono-, di-, and trialkyl substituted benzene or naphthalene. Compounds that are especially preferred for sulfonation to the corresponding sulfonic acids are those having the structure

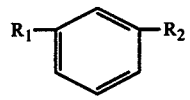

wherein $R_1$ is a hydrogen atom or an alkyl group that contains from 1–14 carbon atoms and $R_2$ is an alkyl group containing from about 14–36 carbon atoms. It will be noted that an alkylated naphthalene may be substituted for the alkylated benzene shown in the above structure. It is further preferred that the average number of carbon atoms among the alkyl groups of the alkylated mono- and bicyclic compounds illustrated above be about 20–40 and optimally about 24–32. Thus, specific examples of alkylated aromatic compounds of this type include tetradecyl benzene, hexadecyl benzene, eicosyl benzene, tetracosyl benzene, dotriacosyl benzene, etc. An especially preferred alkylated monocyclic aryl sulfonic acid is the sulfonic acid of octacosyl benzene.

Especially preferred alkyl mono-aryl sulfonic acids are those acids that are formed by alkylating benzene with oligomers of propylene or $C_4$–$C_{10}$ 1-alkenes and thereafter sulfonating the resulting alkylate. The class of compounds may thus be identified as the polyalkyl benzene sulfonic acids. Insofar as the present invention is concerned, the compounds of this type that are of special interest are the compounds where the alkyl groups are derived from olefin polymers and contain from about 20 to about 40 carbon atoms each and especially about 25 to 32 carbon atoms and especially preferred compound of this type used in the present invention is the octacosyl benzene sulfonic acid wherein the alkyl radical is derived from a nominal 28 carbon propylene oligomer.

The oil-soluble phosphorous-containing acids can be represented by the following four general formulae:

| | |
|---|---|
| (1) $RZPOZ_2H$ | phosphoric or thiophosphoric acids; |
| (2) $(RZ)_2PZ_2H$ | |
| (3) $(R)_2PZ_2H$ | phosphinic or thiophosphinic acids; and, |
| (4) $R\ POZ_2H$ | phosphonic or thiophosphonic acid |

wherein R is one or two (same or different) $C_3$–$C_{70}$ hydrocarbyl radicals such as alkyl, aryl, alkaryl, aralkyl, and alicyclic radicals to provide the required oil solubility, O is oxygen and Z is oxygen or sulfur. The acids are usually prepared by reacting $P_2O_5$ or $P_2S_5$ with the desired alcohol or thiol to obtain the substituted phosphoric acids. The desired hydroxy or thiol compound should contain hydrocarbyl groups of from about 3 to about 70 carbon atoms with at least 5 carbon atoms average to provide oil solubility to the product. Examples of suitable compounds are hexyl alcohol, 2-ethylhexyl alcohol, nonyl alcohol, dodecyl alcohol, stearyl alcohol, amylphenol, octylphenol, nonylphenol, methylcyclohexanol, alkylated naphthol, etc., and their corresponding thio analogues; and mixtures of alcohols and/or phenols such as isobutyl alcohol and nonyl alcohol; orthocresol and nonylphenol; etc. and mixtures of their corresponding thio analogues.

In the preparation of the hydrocarbyl substituted thiophosphoric acids, any conventional method can be used, such as for example the preparation described in U.S. Pat. Nos. 2,522,570; 2,579,038 and 2,689,220. By way of illustration, a dialkaryl substituted dithiophosphoric acid is prepared by the reaction of about 2 moles of $P_2S_5$ with about 8 moles of a selected alkylated phenol, e.g. a mixture of $C_8$–$C_{12}$ alkyl substituted phenols, i.e. nonyl phenol, at a temperature of from 50° C. to 125° C. for about 4 hours. In the preparation of hydrocarbyl substituted thiophosphinic acids as conventionally known, a disubstituted phosphine is oxidized to give disubstituted thiophosphinic acids (see F.C. Whitmore's "Organic Chemistry" published by Dover Publications, New York, NY (1961) page 848).

Particularly preferred for preparation of oil-soluble phosphoric, phosphonic and phosphinic acids useful in the process of the invention are mixed aliphatic alcohols obtained by the reaction of olefins of carbon monoxide and hydrogen and substituted hydrogenation of the resultant aldehydes which are commonly known as "oxo" alcohols, which oxo alcohols for optimum use according to this invention will contain an average of about 13 carbon atoms. Thus for the purpose of this invention a di-$C_{13}$ Oxo phosphoric acid which has an acid dissociating moiety with a pK of about 2.0 is preferred. The oil soluble phosphorous-containing acids are readily prepared from these alcohols by reaction with $P_2P_5$ as is well known in the art.

Another class of useful haze treating agents are oil-soluble hydrocarbyl substituted maleic acids of the general formula

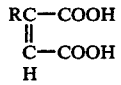

wherein R is an oil-solubilizing, hydrocarbyl group, preferably containing from 12 to 70 carbons, as earlier referenced in regard to the phosphorous-containing acids. Representative of these oil soluble maleic acid derivatives are dodecylmaleic acid (1,2-dicarboxyl tetradecene-1), tetradecylmaleic acid, eicosylmaleic acid, triacontanylmaleic acid, polymers of $C_2$–$C_5$ mono-olefins having from 12 to 70 or more carbons substituted onto said maleic acid, etc.

Additional haze treating agents are oil soluble hydrocarbyl, preferably containing from 12 to 70 carbons, substituted malonic acid of the general formula

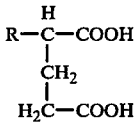

wherein R has the meaning set forth above as an oil solubilizing, hyrocarbyl group which is illustrated by the following representative compounds which include the malonic acid counterparts of the above-referenced hydrocarbyl substituted maleic acids, i.e. dodecylmalonic acid (1,3-dicarboxypentadecane), tetradecyl malonic acid, etc.

Another class of haze treating agents are oil-soluble hydrocarbyl, preferably containing from 12 to 70 carbons, substituted sulfuric acids of the general formula $RHSO_4$ wherein R has the meaning set forth above as an oil-solubilizing group which is represented by the following compounds which include dodecylsulfuric acid; tetradecylsulfuric acid, eicosylsulfuric acid, triacontanylsulfuric acid, etc.

A further group of strong acids which can be used in accordance with the invention to treat the haze producing materials are oil-soluble mono- and di- α-substituted hydrocarbyl carboxylic acids having the general formula:

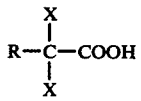

wherein R is a $C_{12}$–$C_{70}$ hydrocarbyl, oil solubilizing group as referenced above and X refers to hydrogen; a halogen such as bromine, chlorine and iodine; nitrilo or a nitro group. These materials are represented by the following: α-nitro; α, α-di-nitro; α-chloro; and α, α-dichlorosubstituted acids such as dodecanoic, pentadecanoic, octadecanoic, docosanoic, octacosanoic, tricontanoic, tetracontanoic, pentacontanoic, hexacontanoic, heptacontanoic, etc.

For purpose of this disclosure, an oil-soluble functionalized polymer having strong acidic groups identical to those strong acid moieties described above having a pK of less than about 2.5 is to be considered an alternative to the lower molecular weight strong acidic anti-hazing agents earlier described. An example of such a polymer type is a sulfonic acid containing ethylene, propylene, ethylidenenorbornene terpolymers (see U.S. Pat. No. 3,642,728). The functional strong acid groups can be positioned in the terminal positions or randomly along the polymer chain. They can be introduced during polymerization by functionalized monomers or by postpolymerization reactions. Care must be exercised to make sure the number of acid groups is low for a given molecular weight to provide sufficient oil solubility. The above example can be used if the sulfonation is at a low enough level to make the polymer soluble.

Haze-Treating Conditions

The oil additive composition containing the ethylene copolymer dispersant additives usually contain from about 0.1 to about 50 wt. % based upon the total weight of the hydrocarbon solution of an ethylene copolymer additive. It has been found that those oil additive compositions which are hazy and can be treated according to the invention contain a hazing material derived from homopolymerization of the grafted moieties. The homopolymer is a highly undesirable by-product of most graft reactions.

It has been found useful to carry out the process by first treating the ethylene copolymer containing oil solution with the oil-soluble organic acid in an amount within the range of from about 0.1 to about 2.5 molar equivalents of oil-soluble organic acid per molar equivalent of haze material. Preferably an oil-soluble strong acid is added in an amount of about 1 equivalent per equivalent of haze. A molar equivalent of haze material is measured by reference to the total molar amount of polyfunctional material which reacts with said grafted copolymer, e.g. one mole of said material equals one molar equivalent of haze material.

Although the chemical character of the haze material is not fully understood, it appears to include a metal stearate, homopolymer of said carboxylic material, graft ethylene copolymer of low molecular weight and when said grafting is carried out in a mineral oil solution, grafted paraffins are present in said haze material.

The treatment of the haze containing ethylene copolymer oil composition is carried out at a temperature of about room temperature to about 250° C., preferably from about 150 to about 200° C. and for a time period of about 0.1 hour up to about 20 hours, preferably from 0.5 to about 3 hours. There is no need to carry out the treatment under pressure. This makes it possible to conduct the process of the invention in an open vessel in the presence of air or inert gas wherein the amount of haze treating agent, i.e. the oil-soluble acid is added with stirring.

A wide range, e.g. 0.001 to 50 wt. %, preferably 0.005 to 20%, of the oil-soluble nitrogen and/or oxygen containing graft polymers treated in accordance with this invention can be incorporated into about a major amount of an oleaginous, material, such as a lubricating oil or hydrocarbon fuel. When used in lubricating oil compositions, e.g., automotive or diesel crankcase lubricating oil, the treated polymer concentrations are within the range of about 0.01 to 20 wt. %, e.g., 0.1 to 15.0 wt. %, preferably 0.25 to 10.0 wt. %, of the total composition. The lubricating oils to which the products of this invention can be added include not only hydrocarbon oil derived from petroleum, but also include synthetic lubricating oils such as esters of dibasic acids and complex esters made by esterification of monobasic acids, polyglycols, dibasic acids and alcohols.

These treated polymeric additives can be incorporated in fuels, such as middle distillate fuels, at concentrations of from about 0.001 l to about 0.5 wt. % and higher, preferably from about 0.005 to 0.2 wt. %, of the total composition. These treated polymeric additives can contribute dispersant activity to the fuel as well as varnish control behavior.

The nitrogen and/or oxygen containing graft polymers treated in accordance with the invention may be prepared in a concentrate form, e.g., from about 10 wt. % to about 50 wt. %, preferably 15 to 49 wt. %, in oil, e.g., mineral lubricating oil, for ease of handling.

The above concentrates may contain other conventional additives, such as dyes, pour point depressants, antiwear agents, antioxidants, other viscosity-index improvers, dispersants and the like.

The following examples illustrate more clearly the process of the present invention. However, these illustrations are not to be interpreted as specific limitations of this invention.

DESCRIPTION OF THE PREFERRED EMBODIMENTS

Practice of this invention may be illustrated by the following examples which show how the invention may be utilized. In these examples, as elsewhere in this specification, all parts are by weight unless specifically indicated otherwise all nitrogen were determined by Kjeldahl analysis.

EXAMPLE 1

23.4 gallons (180 lbs.) of a 15 wt. % solution of an ethylene-propylene copolymer concentrate (made by the Ziegler-Natta process using $H_2$-moderated $VOCl_3$/aluminum sesquichloride catalyst; having a crystallinity of less than 25%; containing about 45 wt. % ethylene and 56 wt. % propylene; and, having a T.E. of 2.11 ($M_w$ = 56,000)) in S100N (Solvent 100 Neutral Mineral Oil)) was heated to 154° C. under a nitrogen blanket. To this was added with stirring 0.87 lbs. (0.33 wt. %) of 2,5-dimethyl hex-3-yne-2,5-bis-tertiary butyl peroxide and 3.42 lbs. (1.29 wt. %, 0.0132 mole %) of maleic anhydride. After about 2.5 hours at 154° C. the system was sparged with nitrogen for 1.5 hours to remove all of the untreated maleic anhydride. To this system at 154° C., 3.6 lbs. (1.36 wt. %, 0.0096 mole %) of N-aminopropyl morpholine was added. All wt. % values are based on the weight of the initial oil solution. The reaction was conducted for 1 hour at 154° C. followed by vacuum stripping (84 KPa) at 154° C. for 5 hours. To the final product was added 77 lbs. of S100N. This resulted in a nitrogen-containing grafted copolymer which contains 0.46 wt. % nitrogen and a final oil concentrate of about 10.5 wt. % graft copolymer whose haze reading was >230 nephelos (off-scale) as measured on a nephelometer purchased from Coleman Industries, Maywood, IL and identified as Model 9.

EXAMPLE 2

The same general procedure of Example 1 was followed modified by change to the charges below:

1.34 lbs. (0.496 wt. %) 2,5-dimethyl hex-3-yne-2,5-bistertiary butyl peroxide;

5.48 lbs. (2.03 wt. %, 0.2 mole %) maleic anhydride; and, 5.8 lbs. (2.15 wt. %, 0.015 mole %) N-aminopropyl morpholine.

The final resulting polymers contained 1.27 wt. % nitrogen and the haze reading of the final oil concentrate was again >230 nephelos.

EXAMPLE 3

The same general procedure of Example 1 was followed modified by change to the charges below given as wt. % of total charge:

| | |
|---|---|
| maleic anhydride | 0.995; |
| 2,5-dimethyl-hex-3-yne-2,5-bistertiary butyl peroxide | 0.198; |
| N-aminopropyl morpholine | 1.003; and, |
| ethylene-propylene polymer concentrate of Ex. 1 | 97.9 |

The resulting grafted copolymer contained 0.21 wt. % nitrogen and the haze reading of the final oil concentrate was again >230 nephelos.

EXAMPLE 4

The same general procedure of Example 1 was followed modified by change to the charges below given as wt. % of total charge: maleic anhydride 1.52; 2,5-dimethyl hex-3-yne-2,5-bistertiary butyl peroxide; 0.392; N,N-dimethylaminopropylamine 1.150; and, the ethylene-propylene polymer concentrate of Example 1 97.3.

The dialysate of the resulting grafted copolymer contained 0.36 wt. % nitrogen and the haze reading of the oil concentrate was again >230 nephelos.

EXAMPLE 5

300 grams of the oil concentrate of Example 3 was placed into a 4-necked one liter flask under a nitrogen blanket. The solution was heated to 205° C. with good agitation and thereafter treated with 3 grams of SA-119. SA-119 is a commercial alkaryl sulfonic acid sold by Esso S. A. France of Port Jerome, France. The SA-119 is a 90% active oil concentrate of primarily $C_{24}$(ave.) alkylbenzene sulfonic acid having a $\overline{M}_n$ of ~500. The reaction was continued for 15 minutes at about 205° C. and then the clear solution cooled and bottled. Haze reading of the final oil concentrate was 48 nephelos as measured on said nephelometer.

EXAMPLE 6

600 grams of the oil concentrate of Example 4 was placed into a flask under a nitrogen atmosphere. The solution was heated to 205° C. with good agitation and then treated with 6 grams of SA-119 at about 205° C. for 4 hours after which the clear solution was cooled and bottled. Haze reading of the final oil concentrate was +59 nephelos as measured on said nephelometer.

EXAMPLE 7

93 lbs. of the oil concentrate of Example 1 was treated with 3.72 lbs. of SA-119 (a 1:1 weight ratio of SA-119 to S100N oil was utilized) at 190° C. for 4 hours. The final clear oil concentrate had a haze reading of 80 nephelos.

EXAMPLE 8

148 lbs. of the oil concentrate of Example 2 was treated with 8.8 lbs. of SA-119 (a 1:1 weight ratio of SA-119 to S100N was used) at 190° C. for 4 hours. The final oil concentrate had a haze reading of 144 nephelos.

In the summary, the preceding examples which teach the product and process of the invention have demonstrated that haze reduction of ethylene copolymer dispersant viscosity index improving oil compositions is readily realized when such compositions are treated according to the process of this invention. Not only is the haze reduced but these compositions remain visually improved in haze reduction for periods of time usually met in the shelf life required for such oil compositions. As noted before, the treatment of the oil compositions with the anti-hazing acid reagent also has the further advantage of improving the sludge dispersancy of the lubricating oil to which the compositions of the invention are added as seen from the following Example.

EXAMPLE 9

In this Example, the efficacy of the derivatized copolymers of this invention as dispersants in lubricating oil is illustrated by comparison with the untreated materials of the prior art in a Sludge Inhibition Bench Test (hereinafter designated SIB). The SIB test has been found, after a large number of evaluations, to be an excellent test for assessing the dispersing power of lubricating oil dispersant additives.

The medium chosen for the SIB test was a used crankcase mineral lubricating oil composition having an original viscosity of about 325 SUS at 38° C. that had been used in a taxicab that was driven generally for short trips only, thereby causing a buildup of a high concentration of sludge precursors. The oil that was used contained only a refined base mineral lubricating oil, a viscosity index improver, a pour point depressant and zinc dialkyldithiophosphate anti-wear additive. The oil contained no sludge dispersant. A quantity of such used oil was acquired by draining and refilling the taxicab crankcase at 1000–2000 mile intervals.

The Sludge Inhibition Bench Test is conducted in the following manner: The aforesaid used crankcase oil, which is milky brown in color, is freed of sludge by centrifuging for 1 hour at about 39,000 gravities (gs.). The resulting clear bright red supernatant oil is then decanted from the insoluble sludge particles thereby separated out. However, the supernatant oil still contains oil-soluble sludge precursors which on heating under the conditions employed by this test will tend to form additional oil-insoluble deposits of sludge. The sludge inhibiting properties of the additives being tested are determined by adding to portions of the supernatant used oil, a small amount, such as 0.5, 1 or 2 weight percent, on an active ingredient basis, of the particular additive being tested. Ten grams of each blend being tested is placed in a stainless steel centrifuge tube and is heated at 138° C. for 16 hours in the presence of air. Following the heating, the tube containing the oil being tested is placed in a stainless steel centrifuge tube and is heated at 138° C. for 16 hours in the presence of air. Following the heating, the tube containing the oil being tested is cooled and then centrifuged for 30 minutes at about 39,000 gs. Any deposits of new sludge that form in this step are separated from the oil by decanting the supernatant oil and then carefully washing the sludge deposits with 25 ml. of pentane to remove all remaining oil from the sludge. Then the weight of the new solid sludge that has been formed in the test, in milligrams, is determined by drying the residue and weighing it. The results are reported as % of sludge dispersed by comparison with a blank not containing any additional additive. The less new sludge formed, the larger the value of percent sludge dispersant, and the more effective is the additive as a sludge dispersant. In other words, if the additive is effective, it will hold at least a portion of the new sludge that forms on heating and oxidation stably suspended in the oil so it does not precipitate down during the centrifuging. Using the above test, the enhanced sludge dispersant activity of the sulfonic acid treated materials is shown over the untreated materials.

TABLE I

| Test Sample | Polymer of Example No. | Concn. Gms. Polymeric Additive 10g. Used Oil | % Sludge Dispersed |
|---|---|---|---|
| 1 | 1 | 0.1 | 63 |
| 2 | 1 | 0.05 | 74 |
| 3 | 7 | 0.1 | 80 |
| 4 | 7 | 0.05 | 88 |
| 5 | 2 | 0.1 | 8 |
| 6 | 2 | 0.05 | 26 |
| 7 | 8 | 0.1 | 8 |
| 8 | 8 | 0.05 | 48 |
| 9 | 3 | 0.1 | 0 |
| 10 | 3 | 0.05 | 0 |
| 11 | 5 | 0.1 | 41 |
| 12 | 5 | 0.05 | 0 |
| 13 | 4 | 0.1 | 32.2 |
| 14 | 4 | 0.05 | 0 |
| 15 | 6 | 0.1 | 80.1 |
| 16 | 6 | 0.05 | 14.5 |

The data of Table I shows that at a concentration of 1% the sulfononium amine salt of the morpholine derivative of a maleic acid graft copolymer had superior dispersant activity to the morpholine derivative - compare Test Sample 1 with 3, 5 with 7, 9 with 11 and 13 with 15. Comparable results are shown for a concentration level of 0.5 wt. %.

It is to be understood that the examples present in the foregoing specification are merely illustrative of this invention and are not intended to limit it in any manner; nor is the invention to be limited by any theory regarding its operability. The scope of the invention is to be determined by the appended claims.

For purposes of this disclosure an oil-soluble organic acid should dissolve in mineral oil, e.g. Solvent 100 Neutral, at 20° C. in at least 5 weight percent based on the weight of said mineral oil.

What is claimed is:

1. A substantially haze-free lubricating oil composition comprising a lubricating oil and from about 0.1 to 50 wt. %, based upon the total weight of said composition, of ethylene copolymeric dispersant-viscosity index improver material, which material has been formed by grafting an ethylene copolymer comprising about 30 to 80 wt. % ethylene and about 20 to 70 wt. % $C_3$ to $C_{18}$ alpha olefin, with an ethylenically unsaturated compound selected from the group consisting of unsaturated carboxylic acid and anhydride of carboxylic acid, said ethylene copolymer when grafted with said carboxylic acid or said anhydride being further reacted with a polyfunctional reactant selected from the group consisting of polyamine, polyol and hydroxy amine, and reacting with from about 0.1 to 8 wt. % of an oil-soluble hydrocarbyl substituted strong acid containing from about 3 to about 70 total carbons to thereby inhibit haze in said composition, and wherein said strong acid is selected from the group consisting of alkyl carboxylic acids, phosphoric acid, phosphonic acid, thiophosphonic acid, phosphinic acid, thiophosphinic acid, sulfonic acid, sulfuric acid, sulfinic acid and alpha-substituted halo- or nitro- or nitrilo- carboxylic acids.

2. A composition according to claim 1 wherein said dispersant-viscosity index improver material is present in said composition in at least a viscosity index improving amount and comprises a $C_3$ to $C_{70}$ hydrocarbyl substituted sulfonic acid salt of a morpholine derivative of a maleic anhydride graft of an ethylene-propylene copolymer.

3. A composition according to claim 1 wherein said dispersant-viscosity index improver material is prepared by solution grafting an ethylenically-unsaturated dicarboxylic acid or anhydride onto said ethylene copolymer comprised of ethylene and at least one $C_3$–$C_8$ alpha-olefin at a temperature of from about 100° C. to about 250° C., in the presence of a high-temperature decomposable free-radical initiator having a boiling point in excess of about 100° C., which grafted polymer is then reacted with said polyamine.

4. A composition according to claim 3 wherein said copolymer consists essentially of ethylene and propylene and has from about 38 to 70 wt. % of ethylene and is present in said composition in an amount ranging from about 0.1 to about 15 wt. %, wherein said copolymer is solution grafted with maleic acid anhydride under an inert environment using a mineral lubricating oil as solvent and the resulting solution from said grafting is treated with from about 0.1 to 2.5 mole equivalents of an oil-soluble alkyl aryl sulfonic acid per molar equivalent of said polyfunctional material.

5. A composition according to claim 4 wherein said sulfonic acid is $C_{24}$ (ave.) alkylbenzene sulfonic acid.

6. A composition according to claim 4 wherein said polyfunctional reactant is an alkylene polyamine.

7. A composition according to claim 4 wherein said polyfunctional reactant is a cyclic nitrogen compound of the general formula:

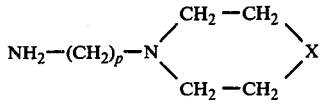

wherein X is oxygen or N-G, G is hydrogen or an omega-amino-alkylene radical of from 1 to 3 carbon atoms and p is an integer of from 1 to 4.

8. A composition according to claim 1, wherein said ethylene copolymer has a molecular weight ($\overline{M}_n$) of 10,000 to 250,000 and a $\overline{M}_w/\overline{M}_n$ ratio of less than 7, and wherein said oil-soluble strong acid contains a hydrogen dissociating moiety which has a pK of less than about 2.5.

9. A composition according to claim 8 wherein said strong acid is a dialkyl substituted benzene sulfonic acid in an amount ranging from about 0.1 to 2.5 molar equivalents per molar equivalent of nitrogen material introduced onto said graft copolymeric viscosity index improver and said reacting with said strong acid is at a temperature ranging from 20° C. to 250° C. for a period ranging from 0.1 to 20 hours.

10. A method of producing the composition according to claim 1, comprising the steps of: (1) dissolving said ethylene copolymer in mineral lubricating oil as solvent; (2) maintaining said solution at a temperature of from about 100° C. to about 250° C. while admixing an ethylenically-unsaturated carboxylic acid or anhydride thereof and a free-radical initiator having a boiling point in excess of about 100° C. into said solution and for a time sufficient to graft said acid or anhydride onto said polymer and said solvent; (3) thereafter reacting said grafted polymeric solution with an alkylene polyamine containing 2 to 60 total carbon atoms and 2 to 12 nitrogen atoms in each molecule and (4) treating said reacted solution with from 0.1 to 2.5 molar equivalents of an oil-soluble hydrocarbyl substituted sulfonic acid per molar equivalent of reacted alkylene polyamine at a temperature of from 20° to 250° C. for a period ranging from 0.1 to 20 hours.

11. A method according to claim 10 wherein said alkylene polyamine is N-aminopropyl morpholine, and said sulfonic acid has an alkaryl group with a molecular weight ranging from 300 to 650 and is represented by the structure

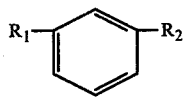

wherein $R_1$ is hydrogen or an alkyl group that contains from 1 to 14 carbon atoms and $R_2$ is an alkyl group that contains from 14 to 36 carbon atoms.

12. A substantially haze-free lubricating oil composition comprising a lubricating oil and from about 0.1 to 50 wt. %, based upon the total weight of said composition, of ethylene copolymeric dispersant-viscosity index improver material, which material has been formed by grafting an ethylene copolymer comprising about 30 to 80 wt. % ethylene and about 20 to 70 wt. % $C_3$ to $C_{18}$ alpha olefin, with a vinyl monomer containing nitrogen, and reacting with from about 0.1 to 8 wt. % of an oil-soluble hydrocarbyl substituted strong acid containing from about 3 to about 70 total carbons, to thereby inhibit haze in said composition.

13. A composition according to claim 12, wherein said vinyl monomer is a vinyl pyridine.

14. A composition according to claim 13, wherein said strong acid is sulfonic acid.

15. A composition according to claim 14, wherein said sulfonic acid is alkaryl sulfonic acid of about 9 to 70 carbon atoms.

16. A composition according to claim 12, wherein said ethylene copolymer consists essentially of ethylene and propylene and has a number average molecular weight in the range of about 10,000 to 250,000; and said strong acid contains about 18 to 40 carbon atoms.

* * * * *